US007050040B2

(12) United States Patent
Daniel et al.

(10) Patent No.: US 7,050,040 B2
(45) Date of Patent: May 23, 2006

(54) SWITCHING OF TWO-PARTICLE ELECTROPHORETIC DISPLAY MEDIA WITH A COMBINATION OF AC AND DC ELECTRIC FIELD FOR CONTRAST ENHANCEMENT

(75) Inventors: Jurgen H. Daniel, Mountain View, CA (US); Robert A. Street, Palo Alto, CA (US)

(73) Assignee: Xerox Corporation, Stamford, CT (US)

( * ) Notice: Subject to any disclaimer, the term of this patent is extended or adjusted under 35 U.S.C. 154(b) by 303 days.

(21) Appl. No.: 10/323,061

(22) Filed: Dec. 18, 2002

(65) Prior Publication Data

US 2004/0119680 A1 Jun. 24, 2004

(51) Int. Cl.
*G09G 3/34* (2006.01)

(52) U.S. Cl. ..... 345/107; 345/209; 345/210

(58) Field of Classification Search ..... 345/107, 345/209, 210; 359/295, 296
See application file for complete search history.

(56) References Cited

U.S. PATENT DOCUMENTS

| | | | | |
|---|---|---|---|---|
| 3,892,568 | A | 7/1975 | Ota | |
| 6,067,185 | A | 5/2000 | Albert et al. | |
| 6,120,588 | A | 9/2000 | Jacobsen | |
| 6,130,774 | A | 10/2000 | Albert et al. | |
| 6,241,921 | B1 | 6/2001 | Jacobson et al. | |
| 6,262,706 | B1 | 7/2001 | Albert et al. | |
| 6,392,785 | B1 | 5/2002 | Albert et al. | |
| 6,473,072 | B1 | 10/2002 | Comiskey et al. | |
| 6,531,997 | B1 * | 3/2003 | Gates et al. | 345/107 |
| 6,693,620 | B1 * | 2/2004 | Herb et al. | 345/107 |

* cited by examiner

*Primary Examiner*—Kent Chang
(74) *Attorney, Agent, or Firm*—Fay, Sharpe,Fagan, Minnich & McKee LLP

(57) ABSTRACT

An electrophoretic display includes a cell having a viewed region and a non-viewed region. The cell contains a suspending fluid and a first particle species and a second particle species dispersed within the suspending fluid. Application of a first electrical field causes the first particle species and the second particle species to vibrate and separate from: one another, the cell walls, the viewed region, and the non-viewed region. Application of a second electric field, in one direction, causes the first particles to migrate toward the viewed region and the second particles to migrate toward the non-viewed region, effecting a color state. The electrophoretic display may be fabricated from multiple display cells arranged on a substrate.

9 Claims, 6 Drawing Sheets

SWITCHING OF TWO-PARTICLE ELECTROPHORETIC DISPLAY MEDIA WITH A COMBINATION OF AC AND DC ELECTRIC FIELD FOR CONTRAST ENHANCEMENT

BACKGROUND OF THE INVENTION

The present invention relates to electrophoretic displays, particularly encapsulated electrophoretic displays, and to a method for enhancing the colored state(s) and contrast of such displays.

Traditionally, electronic displays such as liquid crystal displays have been made by sandwiching an optoelectrically active material between two pieces of glass. In many cases, each piece of glass has an etched, clear electrode structure formed using indium tin oxide (ITO). A first electrode structure controls all the segments of the display that may be addressed, that is, changed from one visual state to another. A second electrode, sometimes called a counterelectrode, addresses all display segments as one large electrode, and is generally designed not to overlap any of the rear electrode wire connections that are not desired in the final image. Alternatively, the second electrode is also patterned to control specific segments of the display. In these displays, unaddressed areas of the display have a defined appearance.

Electrophoretic displays offer many advantages compared to liquid crystal displays. Electrophoretic display media are generally characterized by the movement of particles through an applied electric field. Encapsulated electrophoretic displays also enable the display to be printed. These properties allow encapsulated electrophoretic display media to be used in many applications for which traditional electronic displays are not suitable, such as flexible displays. Additionally, electrophoretic displays typically have attributes of good brightness, wide viewing angles, high reflectivity, state bistability, and low power consumption when compared with liquid crystal displays. However, problems with the image quality, specifically the contrast, to date has been less than optimal. Contrast is defined as the ratio of the white state to the dark state reflectance of the display. Contrast enables the eye to easily distinguish between light and dark.

One example of an electrophoretic display involves the use of an electrophoretic ink which uses cells or microcapsules filled with black and white particles. The particles can be electrically manipulated to position themselves on the top or the bottom of the microcapsule or cell and therefore generate black or white surface visibility to an observer. In electrophoretic displays, the particles are oriented or translated by placing an electric field across the cell. The electric field typically includes a direct current field. The electric field may be provided by at least one pair of electrodes disposed adjacent to a display comprising the cell. Actual display of black or white colors is accomplished by manipulating the position of the particles in correspondence with the observing angle. Once set for a black state or a white state, the display maintains its color until a different configuration is forced through the application of a subsequent electrical field.

The purpose of this disclosure is to describe the switching of a two-particle electrophoretic display comprising two-particle electrophoretic ink consisting of a first particle species of a first color (e.g. white) and a second particle species of a second color (e.g. black) suspended in a clear medium. The different colored particles carry opposite charges. Current electrophoretic displays are switched by application of a DC voltage in order to move the charged pigment particles. The switching of the polarity of the DC voltage results in moving the white particles to a first electrode (i.e. viewed region) and the black particles to a second electrode (i.e. non-viewed region) and vice versa.

Due to particle clustering, settling, adhesion, etc., particularly at high particle densities, the respective colored states and contrast ratio is often degraded because particles of one color are trapped near or at the viewing region by particles of the other color. This trapping of the undesired colored particles reduces the contrast ratio at the viewing region. In other words, a white state is not completely comprised of white particles and a black state is not completely comprised of black particles at the viewed region.

SUMMARY OF THE INVENTION

This invention relates to an improved method for enhancing the colored states and improving the contrast image of an electrophoretic display. In particular, the present invention provides for a two-particle electrophoretic display, along with methods and materials for use in such displays. The electrophoretic display may be filled into a grid of cells made from, for example, a photopolymer material. In the electrophoretic display of the present invention, the particles are vibrated, rotated, and moved by application of electric fields. One electric field may be an alternating current (AC) field and another electric field may be a direct current (DC) field. The electric fields may be created by at least one pair of electrodes disposed adjacent a suspending fluid containing the particles. The particles may be made up of some combination of dye, pigment, and/or polymer. It will be appreciated that the present invention may also be applied to a one-particle electrophoretic display in which the particles are dispersed in a dyed suspending fluid or a display in which the particles have a positively charged hemisphere and a negatively charged hemisphere differentially colored, respectively.

The electrophoretic display may take many forms. The display may comprise an array of cells each formed from a limitless variety of sizes and shapes. The perimeter of the cells may, for example, form a polygon, circle, or other geometric configuration and may have dimensions in the millimeter range or the micron range. The particles may be one or more different types of particles. The particles may be colored and may be positively or negatively charged. The display may further comprise a clear or dyed dielectric suspending fluid in which the particles are dispersed.

This invention provides novel methods for controlling and electronically addressing particle-based displays. Additionally, the invention discloses applications of these methods and associated materials on substrates which are useful in large area, low cost, or high durability applications.

In one aspect, the invention relates to an encapsulated electrophoretic display which includes a cell having a first or viewed region and a second or non-viewed region and containing a suspending fluid with a plurality of first particles of a first electrical charge and a plurality of second particles of a second electrical charge. The first particles and the second particles are dispersed within the suspending fluid. The first particles have a first color (e.g. white) and the second particles have a second color (e.g. black). The application of a first electrical field causes the first particles and the second particles to vibrate and separate from each other. Application of a second electrical field, having a first polarity, effects a first color state by causing the first particles to migrate towards the viewed region and the second particles to migrate towards the non-viewed region.

In another aspect, the invention relates to a method of improving the colored states and contrast ratio of an encapsulated electrophoretic display comprising the steps of: providing a two-particle electrophoretic display consisting of at least one first particle of a first color and a first electrical charge and at least one second particle of a second color and a second electrical charge; suspending the first particles and the second particles in a clear medium contained in a matrix of photopolymer cells, each cell having a viewed region and a non-viewed region. Application of an alternating current electrical field causes the first particles and the second particles to vibrate and separate. This effect reduces the adhesion of the particles with: the other particles, the cell walls, the non-viewed region, and the viewed region. Application of a second direct current electrical field, having a first polarity, causes the migration of the first particles toward the viewed region and the second particles toward the non-viewed region.

In yet another aspect, the invention relates to an encapsulated electrophoretic display which includes a cell having a first or viewed region and a second or non-viewed region and containing a dyed suspending fluid with a plurality of particles of an electrical charge. The particles are dispersed within the dyed suspending fluid. The particles have a first color (e.g. white) and the fluid has a second color (e.g. black). The application of a first electrical field causes the particles to vibrate and separate from each other. Application of a second electrical field, having a first polarity, effects a first color state by causing the particles to migrate toward the viewed region.

BRIEF DESCRIPTION OF THE DRAWINGS

The invention may take physical form in certain parts and arrangements of parts, several preferred embodiments of which are described in the specification and illustrated in the accompanying drawings which form a part hereof and wherein.

DETAILED DESCRIPTION OF THE INVENTION

The present application relates to improved encapsulated electrophoretic displays and, more particularly, to the colored states and resultant contrast of such displays. Generally, an encapsulated electrophoretic display includes one or more species of particles that either absorb or scatter light. One example, in which this invention relates, is a system in which the cells or capsules contain two separate species of particles suspended in a clear suspending fluid. One species of particles may be white, while the other species of particles may be black. The particles are commonly solid pigments, dyed particles, or pigment/polymer composites. The two species of particles may also have other distinct properties, such as, fluorescence, phosphorescence, retroreflectivity, etc.

An encapsulated electrophoretic display can be constructed so that the optical state of the display is stable for some length of time. When the display has two states which are stable in this manner, the display is said to be bistable. The term bistable will be used to indicate a display in which any optical (colored) state remains fixed once the addressing voltage is removed. For the purpose of this invention, the bistable states represent a white state and a black state.

Electrophoretic displays of the invention are described below. Preferably, these displays are microencapsulated two-particle species electrophoretic displays, but also may include one-particle species electrophoretic displays or particles with a positively charged hemisphere and a negatively charged hemisphere differentially colored, respectively. Concepts of the invention include providing a reflective display which provides improved colored states and a higher contrast ratio than heretofore realized.

Figure 1:
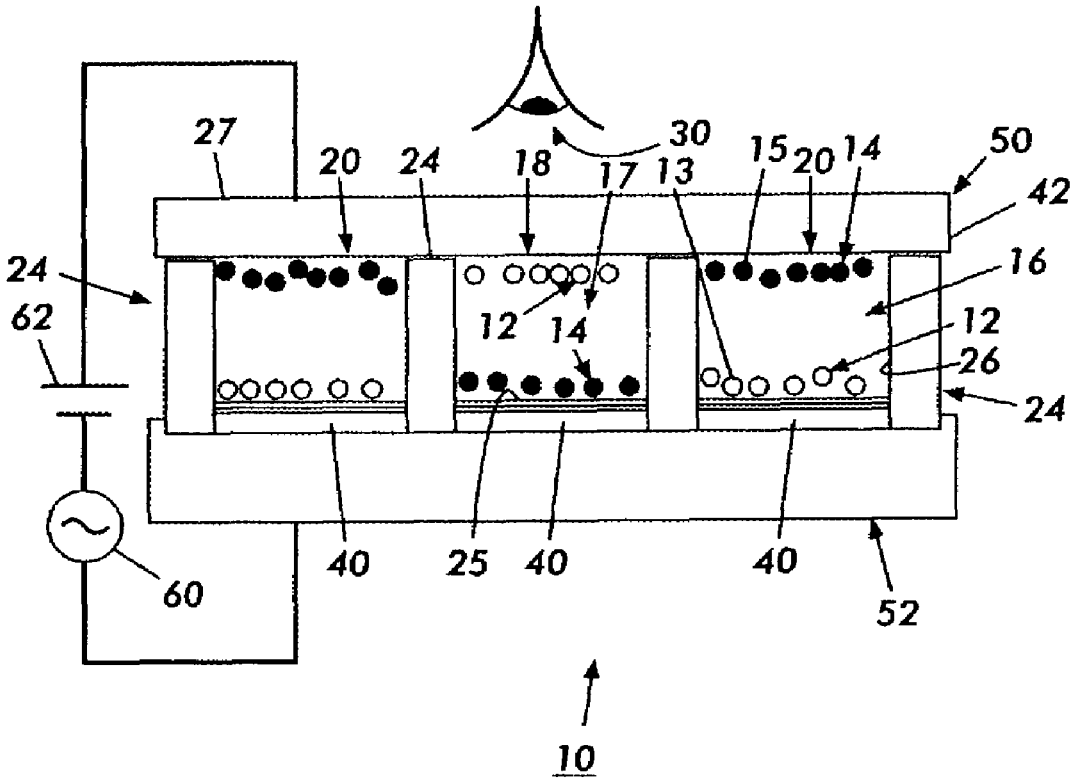
FIG. 1 shows a series of cells containing particles in a suspending fluid and having electrodes disposed adjacent thereto.

Referring to FIG. 1, a two-particle electrophoretic display 10 is shown, which consists of one particle species of a first color 12 (e.g. white) and another particle species of a second color 14 (e.g. black). The display 10 further comprises a clear suspending or carrier fluid 16 in which the two-particle species 12, 14 are dispersed. The particles 12, 14 and carrier fluid 16, are together referred to as the particle dispersion and/or two particle electrophoretic ink 17. An optically transmissive cell 24 surrounds the particle dispersion 17. The first and second particles 12, 14 differ from each other optically and in terms of at least one other physical characteristic that provides the basis for their separation. For example, the particles 12, 14 are colored differently and have different surface charges. Such particles may be obtained by surrounding differently colored pigment core particles with transparent polymer coatings having different zeta potentials. As shown, the two-particle electrophoretic ink 17 consists of one particle species of a first white color 12 and another particle species of a second black color 14. In one configuration, the black colored particles 14 carry a positive charge 15, while the white colored particles 12 carry a negative charge 13. The particle size can range from about 0.1 micron to about 10 microns. In the absence of an electric field, the particles 12, 14 are substantially immobile.

There is much flexibility in the choice of particles for use in electrophoretic displays. For purposes of this invention, the particles 12, 14 are any components that are charged or capable of acquiring a charge (i.e. has or is capable of acquiring electrophoretic mobility). The particles 12, 14 may be neat pigments, dyed pigments, or pigment/polymer composites, or any other component that is charged or capable of acquiring a charge. The particles 12, 14 may be surface treated so as to improve charging or interaction with a charging agent, or to improve dispersability. A preferred white particle that may be used in electrophoretic displays according to the invention are particles of titania. The titania particles may be combined with a polymeric resin and may be coated with a metal oxide, such as aluminum oxide or silicon oxide, for example. The titania particles may have one, two, or more layers of metal oxide coating. For example, a titania particle for use in electrophoretic displays of the invention may have a coating of aluminum oxide and a coating of silicon oxide. The coatings may be added to the particle in any order. The coatings should be insoluble in the suspending fluid 16. Additionally, the black particles 14 may be absorptive, such as carbon black or colored pigments used in paints and ink. The pigments should also be insoluble in the suspending fluid 16.

As discussed, the particles 12, 14 are dispersed in a suspending fluid 16. The suspending fluid 16 should have a low dielectric constant. The fluid 16 should be clear, or substantially clear, so that the fluid 16 does not inhibit viewing the particles 12, 14. The suspending fluid 16 containing the particles 12, 14 can be chosen based on properties such as density, refractive index, and solubility. The suspending fluid 16 may be made from a hydrocarbon including, but not limited to, dodecane, tetradecane, toluene, xylene, and the aliphatic hydrocarbons in the Isopar™ series. Isopar™ is a registered trademark of The Exxon Corporation, Houston, Tex.

Figure 2:
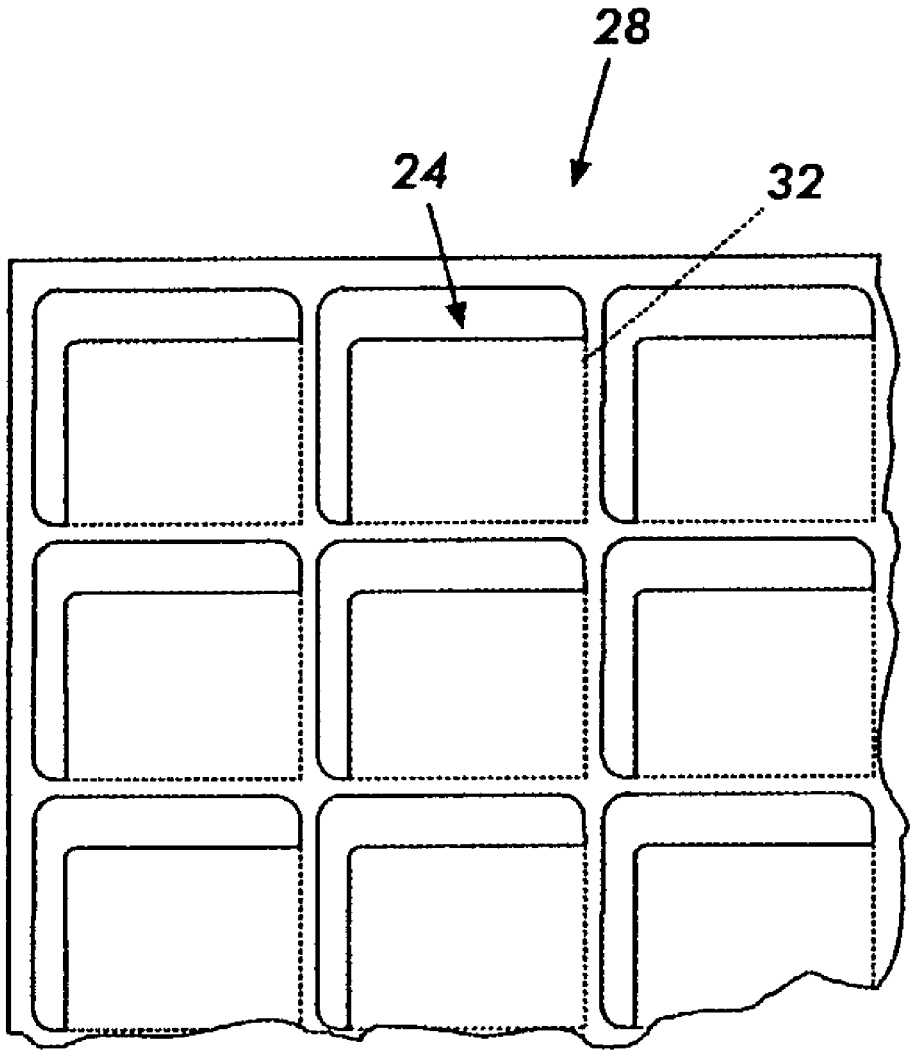
FIG. 2 shows a top perspective view of a sample portion of several cells arranged in a grid or array.

As shown in FIG. 1, three cells 24 are displayed. It will be appreciated that any number of grids or arrays 28 of cells 24 may be arranged (refer to FIG. 2). It is further appreciated that the actual display of a black color state 20 or a white color state 18 is accomplished by manipulating the position of the particles 12, 14 in each cell 24 in correspondence with the observing angle 30. As shown, the cells 24 are cubical in geometry. It will be further appreciated that any number of geometric configurations may be utilized. The cells 24 represent a spacer layer and may be made from a photopolymer (i.e. SU-8). The cells may also be made by microencapsulation methods including, but not limited to, coacervation, or interfacial polymerization as described in U.S. Pat. No. 6,392,785 to Albert, et al., which is incorporated herein by reference. The cells may also be made by molding or embossing. The walls 26 of the cells 24 may be coated to prevent particle adhesion. For the invention described herein, the cell geometry is not essential. As an example, the visible square viewing region 32, as shown in FIG. 2, is approximately 200 microns along each side. The use of separate cells 24 prevents agglomeration and settling of the particles 12, 14.

Referring again to FIG. 1, an addressing scheme for controlling the color state of the display 10 is shown in which an electrode 40 (or set of electrodes) is adjacent a non-viewed region 25 (i.e. bottom or rear surface) of the cells 24 and another continuous top electrode 42 is adjacent a viewed region 27 (i.e. top or front surface) of the cells 24. The top electrode 42 may take the form of an indium tin oxide coating (ITO) of a transparent glass substrate 50 overlying the cell array 28. The glass substrate 50 may be similar to those used in liquid crystal displays. The ITO top electrode 42 may be evaporated onto the top glass substrate 50. The ITO top electrode 42 is transparent, and the colored states 18, 20 are viewed through the ITO top electrode 42. Underlying the cell array 28 is a glass bottom substrate 52. Alternately, the bottom substrate 52 may be a silicon wafer with patterned electrodes or an active matrix backplane, to be described hereinafter. It will be appreciated that the top and bottom electrodes 40, 42 may also be formed from flexible material, such as ITO coated Mylar™. Mylar™ is a registered trademark of E.I. DuPont Corporation, Wilmington, Del.

It will also be appreciated that the viewed and the non-viewed regions can be arranged laterally (not shown) so that the non-viewed region (although observable) is significantly smaller in area with respect to the viewed region (such as in laterally driven electrophoretic displays).

The electrodes 40, 42 are connected to a pair of voltage sources 60, 62. One voltage source 60 provides an AC (alternating current) field while the other voltage source 62 provides a DC (direct current) field.

As discussed, the different colored particles 12, 14 carry opposite charges 13, 15, respectively. Current electrophoretic displays switch their color states using a DC voltage only in order to move the charged pigments to a viewing region. At high particle densities, the contrast ratio is often degraded because particles of one color are trapped near the viewed region by particles of the other color (FIG. 5E). In accordance with concepts of the present invention, a proposed method prevents such trapping, thereby improving the contrast of the display 10. Specifically, the electric field generated by a DC voltage 62 is overlaid with an electric field generated by an AC voltage 60. The voltages 60, 62 are applied between the top and bottom electrodes 42, 40. The AC voltage 60 is used to set the particles 12, 14 into a vibrating motion. While the particles 12, 14 are vibrating and shaking back and forth, the DC voltage 62 is ramped up (increased) to its maximum value. This process enables particles 12, 14 to move past each other more easily, and prevents agglomeration of particles 12, 14 during the switching process and is helpful in shaking loose particles 12, 14 which are sticking to other particles 12, 14, the viewed region 27, the walls 26, and/or the non-viewed region 25 of the cells 24. The ramping of the DC voltage 62 involves moving from a lower to a higher voltage until the total voltage is either positive or negative. As long as the DC voltage 62 is less than the amplitude of the AC voltage 60, the pair of voltages 60, 62 exhibit a reverse pulse which moves the particles 12, 14 slightly in a direction opposite to the direction of migration. Once the total voltage is either positive or negative, the AC voltage 60 may be switched off.

As an example of addressing the display 10, for particles 12, 14 of about 1–10 microns in diameter, an AC frequency in the range of 10–150 Hz may be applied. For smaller particles and/or particles with a higher charge and a higher mobility, a higher frequency (i.e. 500 Hz) may be applied. The amplitude of the AC voltage 60 is approximately equivalent to an electric field of about 1–2 volts/micron. While the AC voltage 60 is applied to the particles, a DC voltage 62 is added and may be slowly increased to a value that moves the particles 12, 14 to the opposite electrodes (described in detail below). During the time period that the DC voltage 62 is increasing, the black and white particles 14, 12, respectively migrate to opposite electrodes. This driving method becomes particularly important when the particle density is high. High particle densities become necessary in thin displays in order to still provide good reflectivity, improved colored states, and high contrast.

Figure 3:
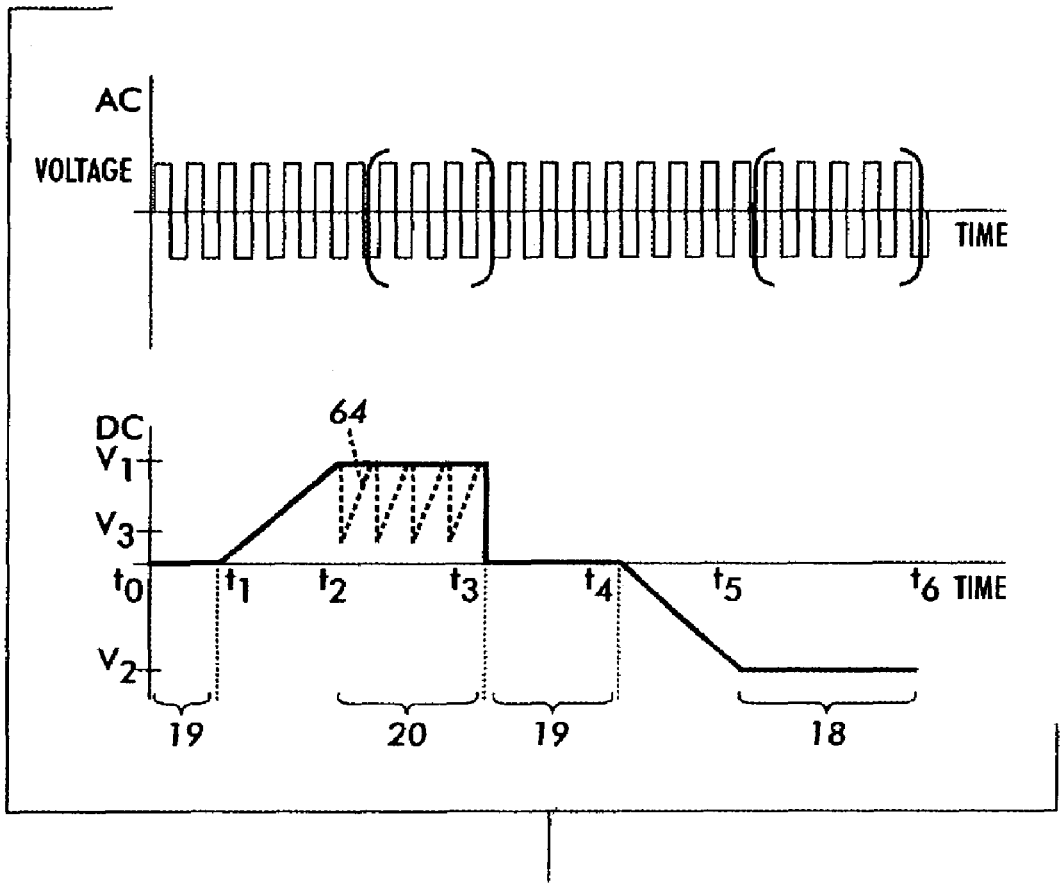
FIG. 3 is a chart showing the voltage sequences (voltage/time) for an alternating current electric field and a direct current electric field.

Referring to FIG. 3, the combined AC and DC voltages 60, 62 are diagramed. As applied to a black and white electrophoretic display 10, initially ($t_0$ to $t_1$) the AC voltage 60 creates a grey state 19 (representing a mixture of the black and white particles) until the DC voltage 62 is applied which creates an electric field in one direction. As shown in FIG. 3, the DC voltage 62 is increased between time $t_1$, and time $t_2$ to a value $V_1$ that moves the particles into an initial black state 20. In order to further improve the arrangement of the electrophoretic particles in a single color state (i.e. black state 20), the DC voltage 62 may be changed or ramped 64 ($V_1 \rightarrow V_3 \rightarrow V_1$) one or more cycles between time $t_2$ and time $t_3$. The duration of each ramping cycle 64 may be from approximately 10 milliseconds to 10 seconds. The actual duration of each ramping cycle 64 depends upon the cell 24 dimensions and the particle 12, 14 mobility. The ramping cycle 64 may be continuous (as shown in FIG. 3) or discontinuous (not shown). The higher the AC frequency the faster can be the ramping cycles 64 of the DC field. The repetitions of the ramping 64 are shown by the dashed lines on the DC voltage diagram. It will be appreciated that the AC voltage 60 may start at a higher voltage and gradually taper to a lower voltage (not shown). Once the black state 20 is complete ($t_3$), the AC voltage 60 may be switched off. The black color state 20 may be switched to a white color state 18 by first applying the AC voltage 60 from time $t_3$ to time $t_6$ and secondly applying a reversed polarity of the DC voltage 62 from time $t_4$ to time $t_6$. As a result, the white particles 12 are attracted to the viewed region 27 and a white color state 18 results (t6).

The DC voltage 62 may increase ($V_0 \rightarrow V_1$) in a linear arrangement or in a non-linear arrangement (FIGS. 4A–4C) from time $t_1$ to time $t_2$. Changes in the DC field are slower than the frequency of the AC field. It will be appreciated that the AC component 60 may be a sine wave, a triangular wave, a sawtooth function, etc. (not shown). It will be further appreciated that the AC and DC voltage signals 60, 62 could be generated with discreet digital voltage levels.

Figure 5A:
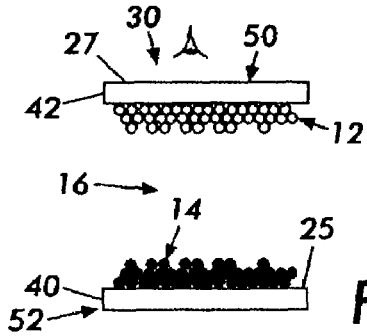
FIG. 5A is a diagrammatic side view of a display cell of an initial colored (white) state in which the white particles are at the viewed region and the black particles are at the non-viewed region.
Figure 5B:
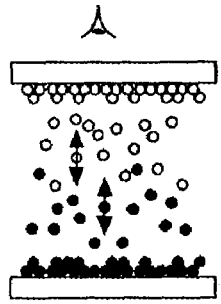
FIG. 5B is a diagrammatic side view of the display cell in which the particles are stirred up as a result of the application of an alternating current electric field.
Figure 5C:
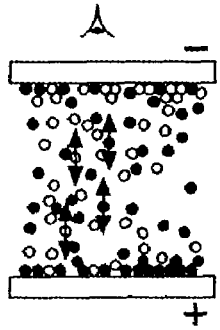
FIG. 5C is a diagrammatic side view of the display cell in which the agitated black particles are in a state of migration toward the viewed region and the agitated white particles are in a state of migration toward the non-viewed region. The migration of both the black particles and the white particles is a result of the application of a direct current electric field.

As shown in FIGS. 5A–5D, the particle migration is displayed going from an observed initial white color state 18 to a black color state 20, respectively. FIG. 5A represents the initial white color state 18. FIG. 5B displays the application of an alternating current electric field 60, whereby the particles begin to oscillate and separate from the other particles, the walls 26, the rear or bottom surface 25, and the top or front surface 27. Once the direct current electric field 62, FIG. 5C, is applied, the particles 12, 14 begin to migrate. As shown in FIG. 5C, the positively charged black particles 14 begin to migrate towards the negatively charged upper electrode 42. At or near the same time, the negatively charged white particles 12 begin to migrate towards the positively charged bottom electrode 40.

Figure 5D:
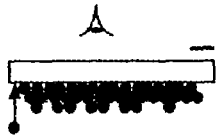
FIG. 5D is a diagrammatic side view of a final colored (black) state of the display cell in which the black particles are at the viewed region and the white particles are at the non-viewed region.
Figure 5D:
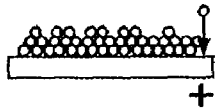
Figure 5E:
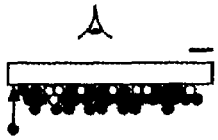
FIG. 5E is a diagrammatic side view of another display cell representing the prior art in which some of the white particles are trapped by the black particles and some of the black particles are trapped by the white particles.
Figure 5E:
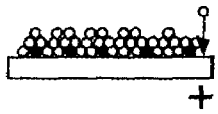

FIG. 5D represents the observed final black color state 20, in which all of the black particles 14 have migrated to the viewed region 27 and all of the white particles 12 have migrated to the non-viewed region 25. It will be appreciated that the black particles 14 have not trapped any white particles 12. Similarly, the white particles 12 have not trapped any of the black particles 14. In contrast, FIG. 5E shows a final black color state 20' of a display 10' without the application of an alternating current electric field. As a result, some of the white particles 12 are trapped by the black particles 14, and are visible to the observer 30. This trapping results in a degradation of the observed colored states and the contrast of the resultant display.

Figure 6:
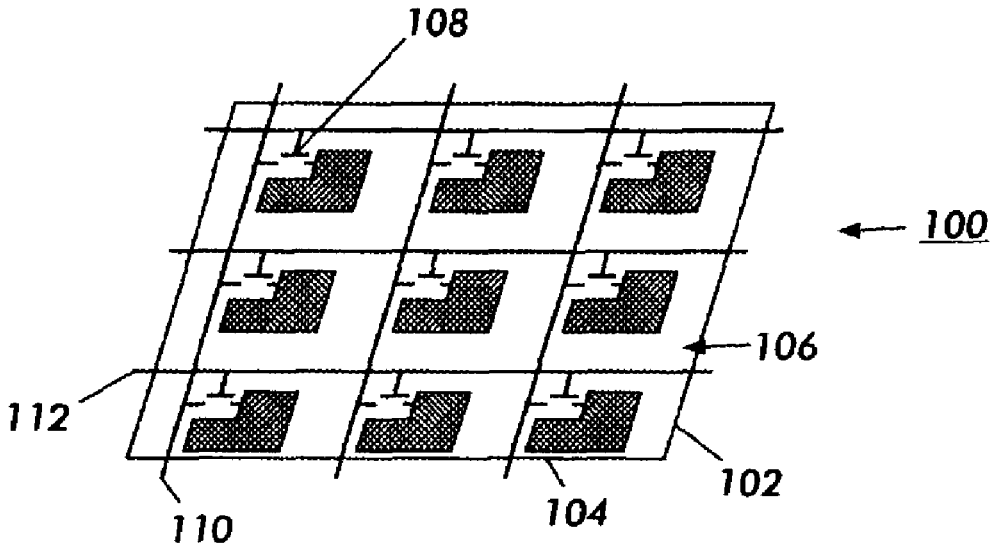
FIG. 6 depicts concepts of the present application used in association with an active matrix display; and, FIG. 7 sets forth a pixel cell of the display shown in FIG. 6.

As an alternative embodiment, the addressing scheme applied to an electrophoretic display as described above may also apply to an active matrix electrophoretic display 100 (FIG. 6). In this embodiment, a typical backplane or back plate 102 architecture implemented using thin film transistors (TFT) 108 comprises an array of individual pixel cells 104 arranged on the substrate 106. It will be appreciated that display 100 includes electrophoretic ink (not shown) and a counterelectrode (not shown) overlying the backplane 102. Pixel cells 104 are selectively activated via the TFTs or pixel switches 108. Gate lines 112 control the pixel switches 108 either block or passe voltage signals on a data line 110. The writing of a frame (i.e. one computer image) involves applying a voltage to each individual pixel 104 so that an image appears. In the described active matrix addressing display 100, the writing is done by addressing the gate line 112 with a voltage pulse. The transistors 108 on the same gate line 112 will go to an open state. The data (voltage levels) which is on the data lines 110 is then passed through the transistor 108 to the pixels 104 (pixel storage capacitors). After another gate line 112 is addressed, new data is written to the associated pixels 104 which are on this gate line 112.

Figure 4A:
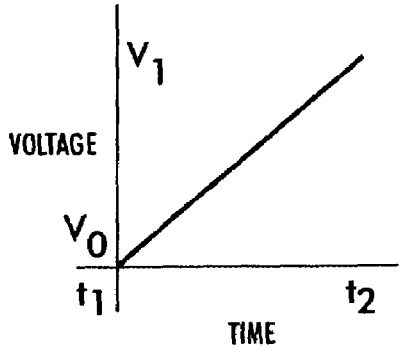
FIG. 4A is a chart showing the linear application of the direct current electric field.
Figure 4B:
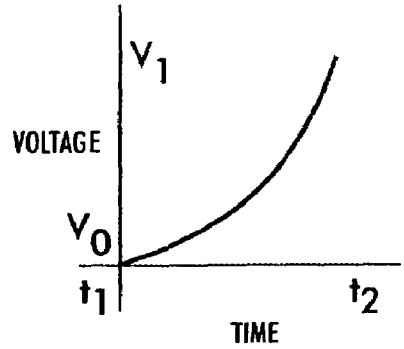
FIG. 4B is a chart showing the non-linear application of the direct current electric field.
Figure 4C:
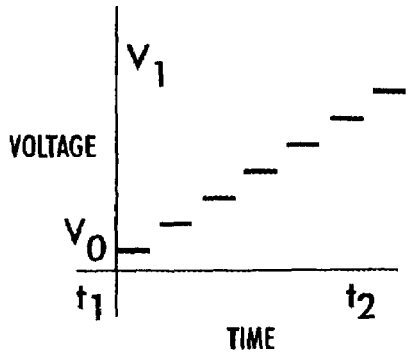
FIG. 4C is a chart showing another non-linear application of the direct current electric field.
Figure 7:
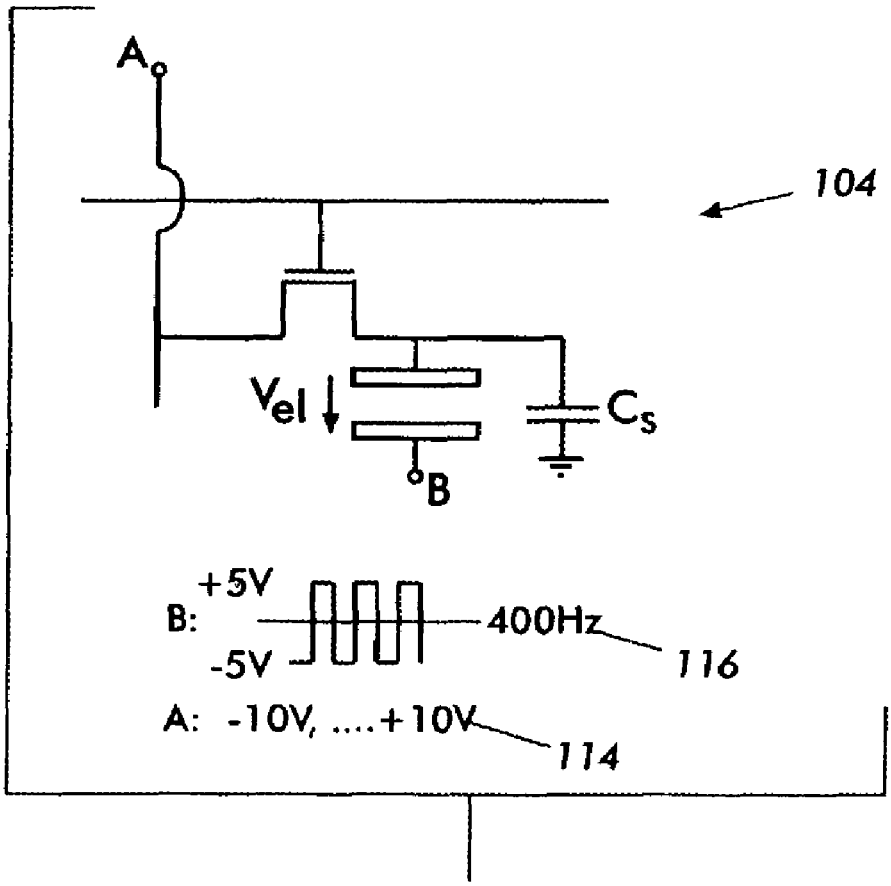

FIG. 7 shows a circuit diagram of one pixel cell 104 in the TFT backplane 102 with example voltages A, B, 114, 116. In this example, the AC voltage would be applied to the common counterelectrode or top transparent electrode (not shown) of the electrophoretic display 100. The ramping of the DC voltage (similar to what is depicted in FIG. 4C) would be done in steps by writing frames (i.e. one computer image) with increasingly higher voltage amplitude on the data lines 110. In the example of FIG. 7, the voltage levels may also be shifted (i.e. the common ground may be shifted to a positive value) so that only positive voltage levels are involved. Instead of addressing the active matrix display 100 "per frame" described above (where all the pixels 104 are addressed with one set of voltage levels, after which all transistors 108 are addressed again with a new set of voltage levels, etc.), one could also perform the addressing per line. In this "per line" addressing, one would switch "on" all the transistors 108 which are connected to a first gate line 112 and then repetitively write data signals (the DC component) to all the associated data lines 110 until the desired voltage state is reached. Then the transistors 108 on this first gate line 112 would be switched "off" and a second gate line 112 would be addressed (this means the transistors 108 on this second gate line 112 would be switched to the "on" state). Again, the data signals on the data lines 110 would be increased or decreased (in steps or continuously varying as shown in FIGS. 4A, 4B, and 4C) until the desired voltage levels would be reached. Then the transistors 108 on this second gate line 112 would be switched "off" and yet another third gate line 112 would be addressed.

Another embodiment for addressing an electrophoretic active matrix display employs a constant voltage potential on the common counterelectrode (point "B" in FIG. 7). A combined "AC/DC" signal similar to the ones described before (or as shown in FIG. 3) is approximated by only changing the voltage levels on the data lines 110. This applies to "per line" addressing and to "per frame" addressing. In this case, "per frame" addressing requires a short frame time so that high enough frequencies (depending on the frequency requirement for the AC voltage requirement) on the pixel cells 104 can be achieved.

The invention has been described with reference to several preferred embodiments. Obviously, alterations and modifications will occur to others upon a reading and understanding of the specification. It is intended to include all such modifications and alterations insofar as they come within the scope of the appended claims or the equivalents thereof.

What is claimed is:

1. A method of improving the contrast ratio of an encapsulated electrophoretic display comprising the steps of:

a. providing a two-particle electrophoretic display consisting of at least one first particle of a first color and a first electrical charge and at least one second particle of a second color and a second electrical charge;

b. suspending said first particles and said second particles in a suspension medium contained in a matrix of cells each having a viewed region and a non-viewed region;

c. applying an AC field to said first particles and to said second particles to vibrate and separate both said first and said second particles;

d. applying a DC field having a first polarity to said first particles and to said second particles affects a first color state by causing migration of said first particles toward said viewed region and said second particles towards said non-viewed region, wherein steps c) and d) are applied simultaneously for at least a portion of time;

e. changing said DC voltage from a first voltage to a second voltage;

f. at least once, changing said DC voltage from said second voltage to a third voltage and finally changing back to said second voltage while affecting same said first color state.

2. The method of claim 1, wherein said DC voltage changes linearly.

3. The method of claim 1, wherein said DC voltage changes non-linearly.

4. The method of claim 1, further comprising the step of changing said DC voltage from said second voltage to said third voltage and changing back to said second voltage.

5. An electrophoretic display comprising:

a cell having a viewed region and a non-viewed region;

a dyed suspending fluid;

a plurality of particles of a first electrical charge;

said particles are dispersed within said suspending fluid;

said particles have a first color and said suspending fluid has a second color;

wherein application of a first electrical field causes said particles to vibrate and separate from each other;

wherein application of a second electrical field having a first polarity affects a first color state by causing said particles to migrate towards said viewed region;

said first electrical field is an alternating current field;

said second electrical field is a direct current (DC) field;

said DC field varies from a first voltage to a second voltage; and, wherein said application of said direct current electrical field, in at least one cycle, is changed from said first voltage to said second voltage and changed back to said first voltage while affecting same said first color state.

6. An electrophoretic display comprising:

a cell having a viewed region and a non-viewed region;

a suspending fluid;

a plurality of first particles of a first electrical charge;

a plurality of second particles of a second electrical charge;

said first particles and said second particles dispersed within said suspending fluid;

said first particles have a first color and said second particles have a second color;

wherein application of an alternating current (AC) electrical field causes said first particles and said second particles to vibrate and separate from each other and to detach from said cell surfaces;

wherein application of a subsequent direct current (DC) electrical field having a first polarity affects a first color state by causing said first particles to migrate towards said viewed region and said second particles to migrate towards said non-viewed region; and;

wherein said application of said direct current electrical field is ramped in at least one cycle from one voltage to another voltage, and back to said one voltage while affecting same said first color state.

7. The display of claim 6, wherein the ramping of said at least one cycle is continuous.

8. The display of claim 6, wherein said AC field includes a voltage, said DC voltage is less than an amplitude of said AC voltage.

9. An electrophoretic display comprising:

a cell having a viewed region and a non-viewed region;

a suspending fluid;

a plurality of first particles of a first electrical charge;

a plurality of second particles of a second electrical charge;

said first particles and said second particles dispersed within said suspending fluid;

said first particles have a first color and said second particles have a second color;

wherein application of an alternating current (AC) electrical field causes said first particles and said second particles to vibrate and separate from each other and to detach from said cell surfaces;

wherein application of a subsequent direct current (DC) electrical field having a first polarity affects a first color state by causing said first particles to migrate towards said viewed region and said second particles to migrate towards said non-viewed region; and, wherein said application of said direct current electrical field is ramped in at least one cycle from one voltage to another voltage, and back to said one voltage while affecting same said first color state, wherein duration of the ramping is from about 10 milliseconds to about 10 seconds.

* * * * *